US010008321B2

(12) United States Patent
Hatakeyama et al.

(10) Patent No.: US 10,008,321 B2
(45) Date of Patent: Jun. 26, 2018

(54) SMALL SIZE TRANSFORMER

(71) Applicant: SUMIDA CORPORATION, Tokyo (JP)

(72) Inventors: Takeshi Hatakeyama, Natori (JP); Akihiro Ono, Watagi-gun (JP)

(73) Assignee: SUMIDA CORPORATION, Tokyo (JP)

( * ) Notice: Subject to any disclaimer, the term of this patent is extended or adjusted under 35 U.S.C. 154(b) by 10 days.

(21) Appl. No.: 15/429,285

(22) Filed: Feb. 10, 2017

(65) Prior Publication Data

US 2017/0294265 A1 Oct. 12, 2017

(30) Foreign Application Priority Data

Apr. 6, 2016 (JP) ..... 2016-076883

(51) Int. Cl.

| | |
|---|---|
| ***H01F 17/04*** | (2006.01) |
| ***H01F 27/24*** | (2006.01) |
| ***H01F 27/30*** | (2006.01) |
| ***H01F 27/26*** | (2006.01) |
| ***H01F 27/32*** | (2006.01) |
| ***H01F 27/28*** | (2006.01) |

(52) U.S. Cl.
CPC ..... *H01F 27/325* (2013.01); *H01F 27/24* (2013.01); *H01F 27/2823* (2013.01)

(58) Field of Classification Search
None
See application file for complete search history.

(56) References Cited

U.S. PATENT DOCUMENTS

| | | | | |
|---|---|---|---|---|
| 5,264,815 | A * | 11/1993 | Umeya | H01F 5/04 24/329 |
| 5,696,477 | A * | 12/1997 | Yamamori | H01F 27/027 336/185 |
| 5,859,577 | A * | 1/1999 | Nihei | H01F 27/325 336/192 |
| 2013/0249659 | A1* | 9/2013 | Tseng | H01F 27/06 336/65 |
| 2015/0325354 | A1* | 11/2015 | Sasaki | H01F 41/02 336/209 |

FOREIGN PATENT DOCUMENTS

JP 2015-216204 A 12/2015

* cited by examiner

*Primary Examiner* — Ronald Hinson
(74) *Attorney, Agent, or Firm* — Oliff PLC

(57) ABSTRACT

A small size transformer is provided with hollow bobbin which has flange-shaped end parts at least on both ends of winding shaft part around which conducting wire formed of reinforced insulation wire is wound, and is formed by through-hole being pierced between the flange parts, box-shaped cover member to be covered on an outside of the bobbin, and magnetic core part formed by combining two E-shaped core members in a manner of surrounding side surface outer circumferential part of cover member, in which middle leg portions of the core members are configured in a manner of being inserted into the through-hole of the bobbin, in which sidewall parts of cover member to be interposed between the wiring part wound around bobbin and the core members are not provided therebetween.

9 Claims, 10 Drawing Sheets

EXTERNAL DIMENSION DIFFERENCE d

PRESENT EMBODIMENT

SMALL SIZE TRANSFORMER

RELATED APPLICATION

This application claims the priority of Japanese Patent Application No. 2016-076883 filed on Apr. 6, 2016, which is incorporated herein by reference.

BACKGROUND OF THE INVENTION

Field of the Invention

The present invention relates to a surface-mounted small size transformer having a suction surface for conveyance in a top plate part to be mounted on various electronic devices, more specifically, to a small size transformer formed by covering an insulating cover on a bobbin around which a conducting wire is wound.

Description of the Prior Art

A number of about 10 mm square small size transformers have been used for various apparatuses or mechanisms, for example. In order to exclude a risk caused by short circuiting or the like and obtain desired characteristics, the small size transformer of this kind is provided with an insulating cover member formed of a resin agent or the like, to be interposed between a wiring part and a magnetic core to wholly cover the wiring part.

For example, FIG. 9 shows a part of a small transformer that has been known so far. In FIG. 9, a cover member 140 is provided with a top plate part 141 having a flat surface to be sucked by a sucking means for component conveyance during assembling, a placement part 143 to be placed on terminal blocks 123A, 123B of a bobbin 120, and sidewall parts (lateral sidewall parts 142A, 142B, a front sidewall part 145 and a back sidewall part (not shown in the figure)) each for connecting the top plate part 141 and the placement part 143. In addition, in a middle step of an outer circumferential part in the four sidewall parts, a core part (not shown) formed by abutting tip parts of two E-type cores to each other is arranged, and is provided with an opening 146 through which middle leg parts of the E-type cores are inserted.

In addition, in the above-described terminal blocks 123A, 123B each, a plurality of terminal pins 124A, 124B and a plurality of coil lead locking projections 125A, 125B are provided, respectively. The coil lead locking projections 125A, 125B are provided for facilitating work for locking end parts of the conducting wire 130 to connect tips of the end parts of the conducting wire 130 to the terminal pins 124A, 124B.

As shown in FIG. 10 in which a part of the cover member 140 is cut, an aspect is shown in which a wiring part 135 of the bobbin 120, the wiring part 135 being a portion around which the conducting wire 130 is wound, is arranged inside the cover member 140. The above-described sidewall parts (142A, 142B and 145) each of the cover member 140 having insulation are positioned between the wiring part 135 and the core part (not shown). Thus, insulation between the wiring part 135 and the core part is to be ensured by the sidewall part.

Related Prior Art

Patent Document 1: Japanese Laid-Open Patent Publication No. 2015-216204(A)

SUMMARY OF THE INVENTION

However, a request for further size reduction on such a small size transformer has recently been strong, and in particular, achievement of size reduction by reducing a length in a cross direction (direction in which the front sidewall part 145 is faced with the back sidewall part; the same applies hereinafter) has been strongly requested.

The present invention has been made in view of such circumstances, and is contemplated for providing, in a surface-mounted small size transformer provided with a cover member, a small size transformer a size of which can be further reduced particularly by reducing a length in a cross direction, while ensuring high insulation performance.

In order to solve the above-described problem, the small size transformer according to the present invention has the features described below.

The small size transformer according to the present invention is provided with:

a hollow bobbin which has flange parts at least on both ends of a winding shaft part around which a conducting wire is wound, and is formed by a through-hole being pierced between the flange parts;

a box-shaped cover member to be covered on an outside of the bobbin; and a magnetic core part having a substantial dual-compartment shape (a substantial two stacked rectangles) in cross section to be arranged by combining a plurality of core members with each other in a manner of surrounding a side surface outer circumferential part of the cover member, wherein a rod-shaped core member portion corresponding to a midline shape in a middle step of the dual-compartment shape in the core member is configured in a manner of being inserted into the through-hole of the bobbin, the conducting wire is formed of a reinforced insulation wire, and both sidewall portions of the cover member, facing the conducting wire wound around the bobbin, are opened, and through portions of the openings, an outermost circumferential portion of the bobbin and an inner wall portion of the core member are arranged facing each other in a close-contact state.

The above-described expression "an outermost circumferential portion of the bobbin and an inner wall portion of the core member are arranged facing each other in a close-contact state" herein means, including not only a case where the opening is formed in both the sidewall portions of the cover member, positioned between the wiring part and the core member, but also a case where both the sidewall portions are wholly eliminated, that the above-described both sidewall portions are not interposed between the wiring part and the core member, and the outermost circumferential portion of the bobbin and the inner wall portion of the core member are arranged in a significantly close state (whether or not both portions are abutted with each other).

The term "reinforced insulation wire" herein means a wire in which the insulation is reinforced in comparison with a general coil wire, and at least two or more insulating coating layers composed of resin members different from each other are coated and laminated.

Preferably, both the sidewall portions of the cover member, facing the conducting wire wound around the bobbin, are eliminated.

Preferably, the plurality of core members are a pair of E-shaped core members.

Preferably, side surface parts each of the core member, the cover member and the bobbin are formed to be flush with each other, and the side surface parts each are formed so as to be integrally turned therearound by an adhesive belt-shaped part having a width over the side surface parts each.

Preferably, an outer circumferential part of the plurality of core members which constitute the magnetic core member having the substantial dual-compartment shape in cross section is formed so as to be turned therearound by a core member fixing use adhesive belt-shaped part having a predetermined width.

Further, preferably, a recessed part is provided in at least one sidewall portion of a top plate part of the cover member, and a gap is formed between the adhesive belt-shaped part turned around the cover member and the recessed part to permit entry into the core member through the gap.

Preferably, the reinforced insulation wire is formed by coating and laminating a conducting wire material with two or more layers of insulation coatings.

Preferably, the insulation coating of the reinforced insulation wire has a withstand voltage of 1,000 V or more.

Further, preferably, a first engagement part is provided on one side of a top surface of a terminal block integrally formed with the bobbin, and a terminal block placement plate to be placed on the top surface of the terminal block for the cover member is provided with a second engagement part to be engaged with the first engagement part to position the cover member relative to the bobbin.

According to the small size transformer of the present invention, the conducting wire is formed of the reinforced insulation wire, and both sidewall portions of the cover member, facing the conducting wire wound around the bobbin, are opened, and through the openings, the outermost circumferential portion of the bobbin, and the inner wall portion of the core member are arranged facing each other in the close-contact state.

The insulation between the conducting wire wound around the bobbin, and the core member arranged in a manner of surrounding the outer circumferential part of a sidewall surface has been so far configured to be ensured by the sidewall surface of the cover member. However, the sidewall portion of the cover member occupies a predetermined proportion in the width of the small size transformer, and therefore it has been difficult to promote further size reduction of the small size transformer.

Therefore, in the small size transformer according to the present invention, the conducting wire is formed of the reinforced insulation wire, according to which both the sidewall portions of the cover member, which have been so far required for ensuring the high insulation between the conducting wire wound around the bobbin and the core member, are opened into a state in which the outermost circumferential portion of the bobbin and the inner wall portion of the core member are closely contacted. Thus, a length of the small size transformer in a direction perpendicular to an axial direction of the bobbin (hereinafter, referred to as the cross direction) can be reduced by a thickness of both the sidewall portions of the cover member in comparison with the conventional art.

Thus, further size reduction can be achieved in the surface-mounted small size transformer by reducing the length in the cross direction while ensuring the high insulation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

DESCRIPTION OF THE PREFERRED EMBODIMENTS

Hereinafter, a small size transformer according to an embodiment of the present invention will be described with reference to drawings. The small size transformer according to the present embodiment is applied to various on-vehicle electronic devices, for example.

Figure 10:
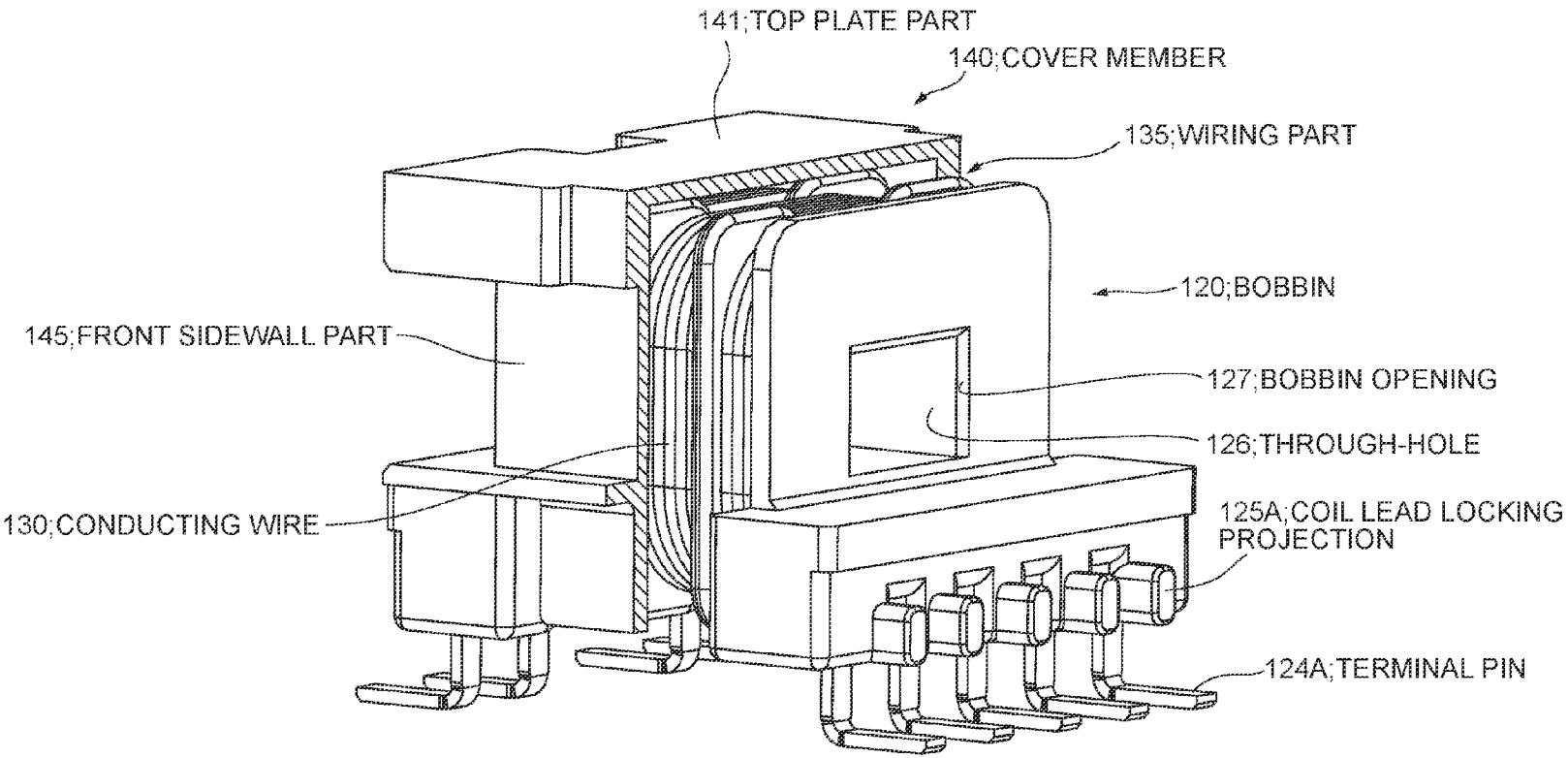
FIG. 10 CONVENTIONAL ART
FIG. 10 is a partial cross sectional view showing a bobbin arranged inside a cover member by partially cutting the cover member in the small size transformer according to the conventional art as shown in FIG. 9.

As shown in FIG. 10, in a small size transformer according to the conventional art, a wiring part 135 of a bobbin 120, the wiring part 135 being a portion around which a conducting wire 130 is wound, is arranged inside a cover member 140, and a cover member 140 having insulation is interposed between the wiring part 135 and a core part (not shown), and high insulation between the wiring part 135 and the core part is to be ensured. On the other hand, a distance between the wiring part 135 and the core part is eventually increased by a wall surface of the cover member 140, and therefore a length of the small size transformer in a cross direction cannot be reduced, and it has been difficult to promote size reduction.

Figure 1:
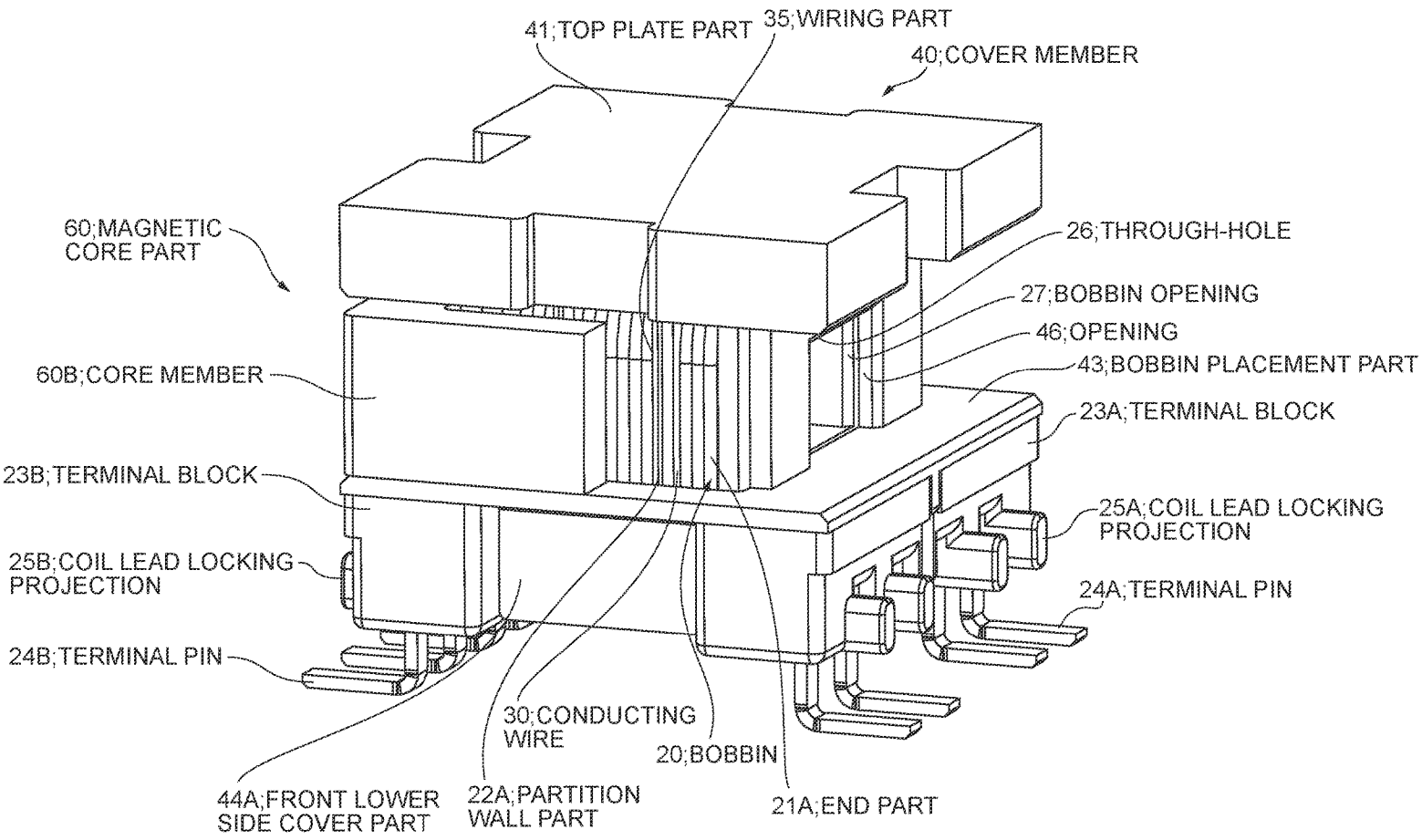
FIG. 1 shows a perspective view obtained by viewing, from an oblique front side, a state in which one core member is omitted in a small size transformer according to an embodiment of the present invention.

In a small size transformer according to the present embodiment, a conducting wire 30 is formed of a reinforced insulation wire, and as shown in FIG. 1, a rod-shaped core member portion of a magnetic core member 60, corresponding to a midline shape in a middle step of a dual-compartment shape, is configured in a manner of being inserted into a through-hole 26 of a bobbin 20, and both sidewall portions of an insulating cover member 40 in a cross direction are configured to be opened (eliminated), and an outermost circumferential portion of the bobbin 20 (a portion in which a distance to core members 60A, 60B among members each of the bobbin 20 is shortest), and an inner wall portion of the core members 60A, 60B are arranged into a close-contact state therebetween. A concept of "both sidewall portions in a cross direction are opened" herein also includes a concept of "both sidewall portions in a cross direction are eliminated."

The high insulation between the wiring part 35 and the core members 60A, 60B (see FIG. 5 for the core member 60A) is ensured by forming the conducting wire 30 of the reinforced insulation wire, and therefore both sidewall portions of the cover member 40 in the cross direction become unnecessary, and the length of the small size transformer in the cross direction can be reduced by a thickness of the two walls (two walls including a front sidewall part and a back sidewall part), and further size reduction can be achieved.

In addition, the above-described conducting wire 30 formed of the reinforced insulation wire is formed by coating and laminating a wire material of copper, aluminum or the like with two or more layers of insulation coatings, and the insulation coating can be formed by using a thermoplastic resin such as a fluorine-based resin, nylon, polyethylene, polypropylene, ethylene propylene copolymer, and other various resin materials such as a thermosetting resin.

The resin materials in layers each to be laminated are formed of materials different from each other.

In addition, the insulation coating of the reinforced insulation wire in the present embodiment has a withstand voltage of at least 1,000 V.

The bobbin 20 is molded by using the thermoplastic resin such as 6,6-nylon, in taking into account moldability, mass productivity, microfabrication performance, electrical insulation, inexpensiveness, mechanical strength and the like, and a winding shaft (not shown) is provided with a wiring part 35 formed by the conducting wire 30 being wound therearound. Moreover, the bobbin 20 is provided with terminal blocks 23A, 23B sealed with the above-described thermoplastic resin, while maintaining insulation between terminal pins 24A and 24B in many sets thereof, by applying an insert molding method, and the bobbin 20 is formed by being integrally molded as a whole.

The cover member 40 has the insulation and a mounting function, and is provided with a top plate part 41 having a flat surface to be air-sucked by a sucking means for component conveyance during assembling, a bobbin placement part 43 to be placed on the terminal blocks 23A, 23B for the bobbin 20, and lateral sidewall parts 42A, 42B for connecting the top plate part 41 and the bobbin placement part 43 (a front sidewall part and a back sidewall part formed in the conventional art are eliminated).

In addition, a rectangular opening 46 into which middle leg portions of the core members 60A, 60B are inserted is pierced in central portions of the lateral sidewall parts 42A, 42B, respectively.

The cover member 40 is provided with a front lower side cover part 44A and a back lower side cover part 44B (see FIG. 3) for protecting the wiring part 35 exposed in a gap portion between the two terminal blocks 23A, 23B.

The magnetic core part 60 is arranged in such a manner that corresponding tip parts of legs each of a pair of E-shaped core members 60A, 60B are abutted with each other, and combined in a manner of a closed magnetic path being formed, and as described above, and to form the magnetic core part 60 into a dual-compartment shape in cross section in a manner of surrounding the sidewall parts of the cover member 40 by such operation.

The middle legs each of the E-shaped core members 60A, 60B are inserted into the through-hole 26 of the bobbin 20 through the opening 46 of the cover member 40.

In addition, in place of the above-described pair of E-shaped core members 60A, 60B, the dual-compartment shape in cross section may be configured by combining an I-shaped core with an E-shaped core, or combining a U-shaped core with a T-shaped core, for example. Moreover, the dual-compartment shape in cross section may be configured by combining three or more core members.

Figure 2:
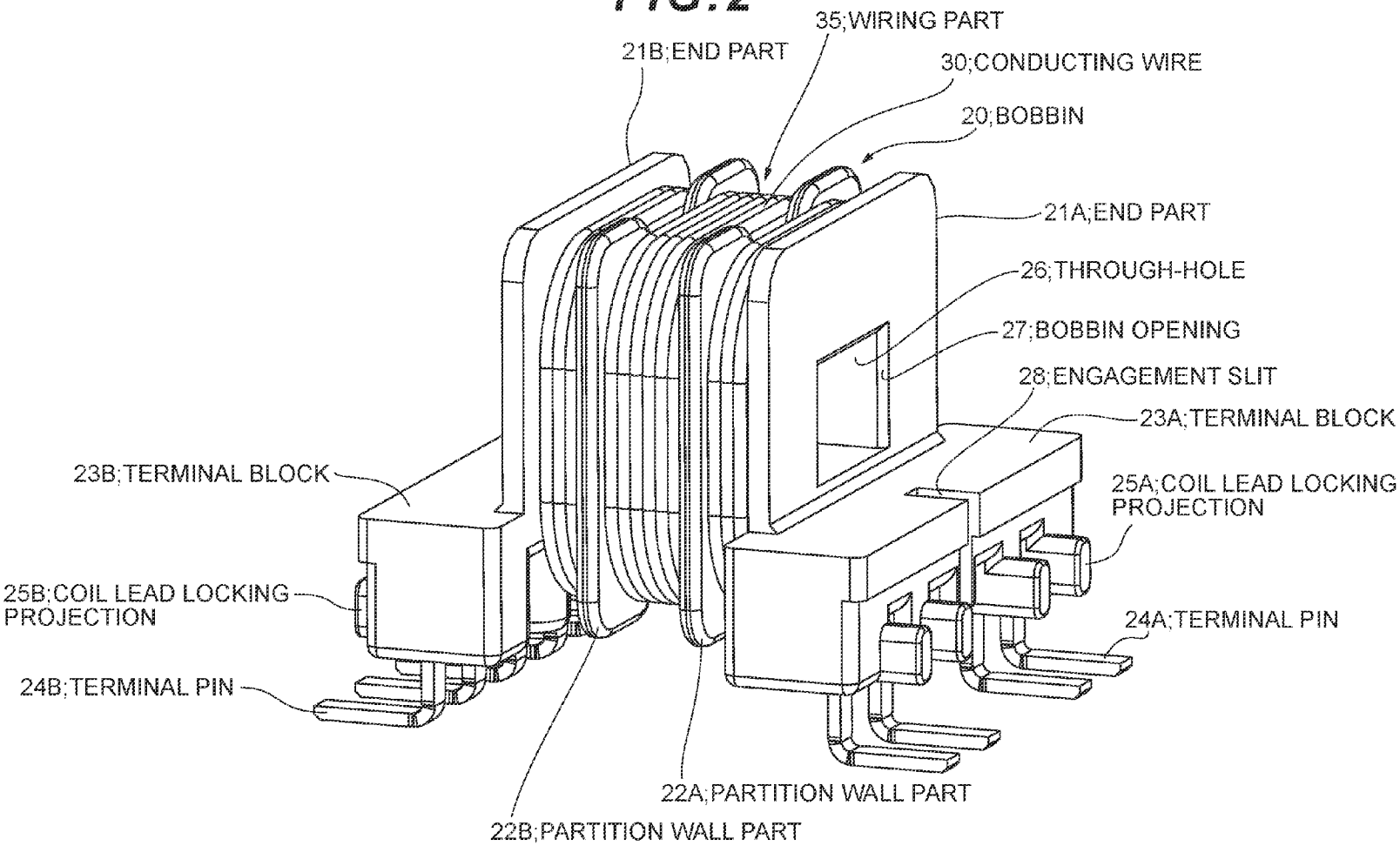
FIG. 2 shows a perspective view obtained by viewing, from an oblique front side, a bobbin around which a conducting wire is wound in a small size transformer according to an embodiment of the present invention.

FIG. 2 shows a bobbin 20 formed by winding a conducting wire 30 around a winding shaft (not shown in the figure) within a reel.

The bobbin 20 is formed by forming flange-shaped end parts 21A, 21B in both ends of the reel, and two partition wall parts 22A, 22B between both ends, respectively. The wiring part 35 has three winding regions divided by both the end parts 21A, 21B and both the partition wall parts 22A, 22B, and a wiring shape of the wiring wire can be improved by dividing the wiring part into a plurality of wiring regions.

The wiring shaft around which the conducting wire 30 is wound is formed into a hollow type in which the through-hole 26 having a rectangular shape in cross section is formed along a central axis, and as described above, the middle legs of the core members 60A, 60B are inserted into the through-hole 26.

The bobbin 20 has terminal blocks 23A, 23B, respectively, in lower parts outside both the end parts 21A, 21B (below a lower edge part of a bobbin opening 27 in the through-hole 26 of the bobbin 20). The terminal blocks 23A, 23B are formed by integrally molding a plurality of L-shaped terminal pins 24A, 24B (4 pins for the terminal pins 24A and 5 pins for the terminal pins 24B), respectively, by applying an insert molding method. Moreover, coil lead locking projections 25A, 25B for once locking the end parts of the conducting wire 30 to easily connect tips of the coil end parts to the terminal pins 24A, 24B are formed near root parts of the terminal pins 24A, 24B, respectively, in corresponding to each pin of the terminal pins.

In the above-described terminal pins 24A, 24B, the conducting wire 30 is connected to the pin which is connected (soldered) to a power supply line or the like of a mounting board (not shown), and an electric current is passed through the conducting wire 30 on a primary side by the connection, and a large voltage is to be generated on a secondary side by electromagnetic induction action.

An engagement slit 28 formed of a longitudinal groove is provided near a central part of one terminal block 23A, and configured to be engaged with an engagement projection 48 (see FIG. 3) of the cover member 40 to be described later.

Figure 3:
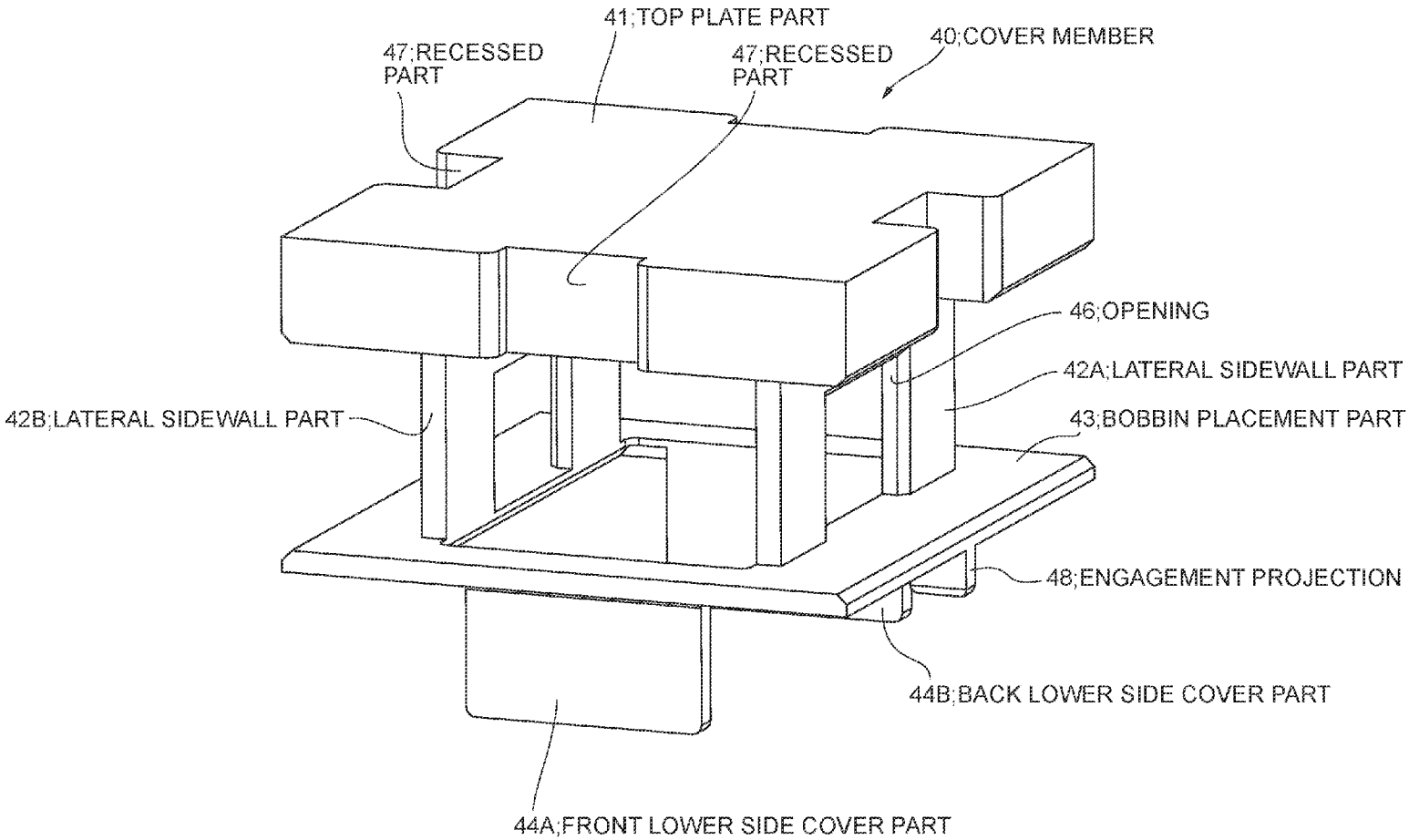
FIG. 3 shows a perspective view obtained by viewing, from an oblique front side, a cover member of a small size transformer according to an embodiment of the present invention.

Next, the above-described cover member 40 will be described by using FIG. 3. As described above, the cover member 40 is covered on the bobbin 20 shown in FIG. 2 in a manner of being fitted thereinto, and on the above occasion, the opening 46 of the cover member 40 is formed so as to coincide with the bobbin opening 27 being an inlet and an outlet of the through-hole 26 of the bobbin 20.

As described above, the top plate part 41 is provided with a flat part as a suction surface so that the small size transformer 1 can be held by air suction and conveyed upon producing an apparatus or the like by automatic assembly.

A recessed part 47 is provided in each sidewall part of the top plate part 41 for convenience of bringing, upon winding an adhesive tape 80 for fixing all members (see FIG. 8) around the sidewall of the small size transformer 1, a measuring terminal for testing insulation performance into contact with the core members 60A, 60B positioned inside the adhesive tape 80 for fixing all the members. A more detail will be described later.

A fin-shaped engagement projection 48 (corresponding to a second engagement part according to the claim) is provided on a lower surface on one side of the bobbin placement part 43 for the above-described cover member 40, and the engagement projection 48 is configured to be fitted into the above-described engagement slit 28 (corresponding to a first engagement part according to the claim) of the bobbin 20, and accordingly the cover member 40 is securely positioned on the bobbin 20 and arranged at a predetermined position. In addition, the engagement slit may be configured to be provided on a side of the bobbin placement part, and the engagement projection to be engaged with the engagement slit may be configured to be provided on a side of the bobbin (terminal block).

As described above, the front lower side cover part 44A and the back lower side cover part 44B for ensuring the insulation of the wiring part 35 are provided.

Incidentally, in the small size transformer 1 according to the present embodiment, the cover member 40 is not provided with the front and back sidewall parts. More specifically, the front and back sidewall parts of the cover member 40 are eliminated, and therefore the bobbin 20 (wiring part 35) arranged inside the cover member 40, and the core members 60A, 60B arranged in a manner of surrounding the sidewall parts of the cover member 40 can be brought close to each other to a degree of abutting with each other.

Thus, the length of the small size transformer 1 in the cross direction can be reduced to promote size reduction of the small size transformer 1.

Figure 4:
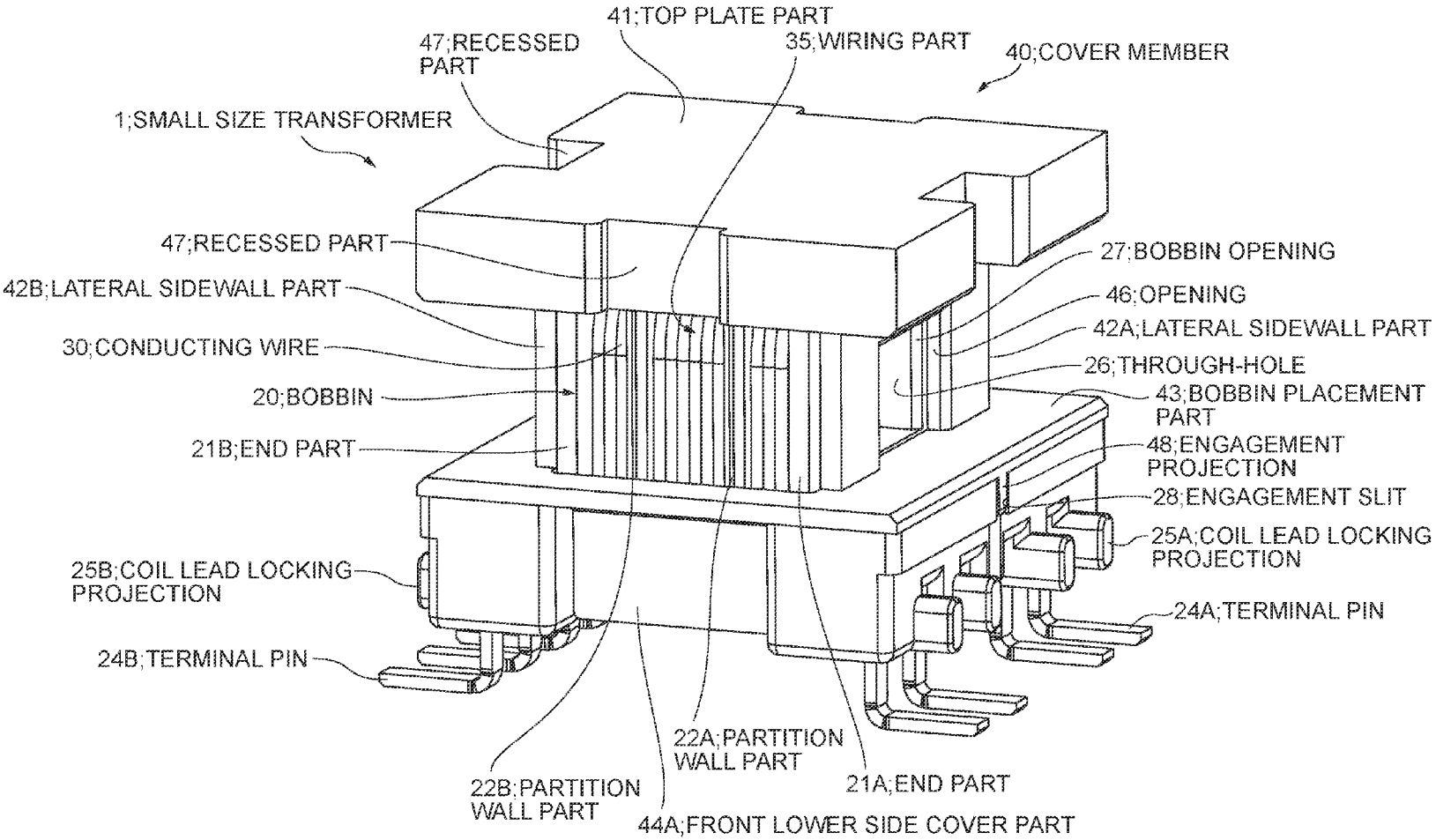
FIG. 4 shows a perspective view obtained by viewing, from an oblique front side, a state in which a whole magnetic core part is omitted in a small size transformer according to an embodiment of the present invention.

FIG. 4 shows an aspect in which a cover member 40 is covered on a bobbin 20 around which the above-described conducting wire 30 is wound, and both are combined. As shown in FIG. 4, on a front side of the small size transformer 1, an outer circumferential surface of any of both end parts 21A, 21B and both partition wall parts 22A, 22B of the wiring shaft part of the bobbin 20, and the conducting wire 30 of the wiring part 35 is projected from front side end parts of both lateral sidewall parts 42A, 42B of the cover member 40. Therefore, the inner wall surface of the core members 60A, 60B (to be fitted into a place between the top plate part 41 and the bobbin placement part 43) each arranged on the bobbin placement part 43 are not abutted with the sidewall part of the cover member 40, on the front side, and is arranged in a state in which the inner wall surface is abutted with or significantly close to the outer circumferential surface of any of both the end parts 21A, 21B and both the partition wall parts 22A, 22B of the bobbin 20, and the conducting wire 30 of the wiring part 35.

Although a status on the front side of the small size transformer 1 has been described above, such a status is the same also on a back side of the small size transformer 1, in which the inner wall surface of the core members 60A, 60B each arranged on the bobbin placement part 43 is to be abutted with the outer circumferential surface of both the end parts 21A, 21B and both the partition wall parts 22A, 22B of the bobbin 20, and the conducting wire 30 of the wiring part 35.

Thus, a distance by a wall thickness of the cover member 40 can be shortened in the length of the small size transformer 1 in the cross direction.

Figure 5:
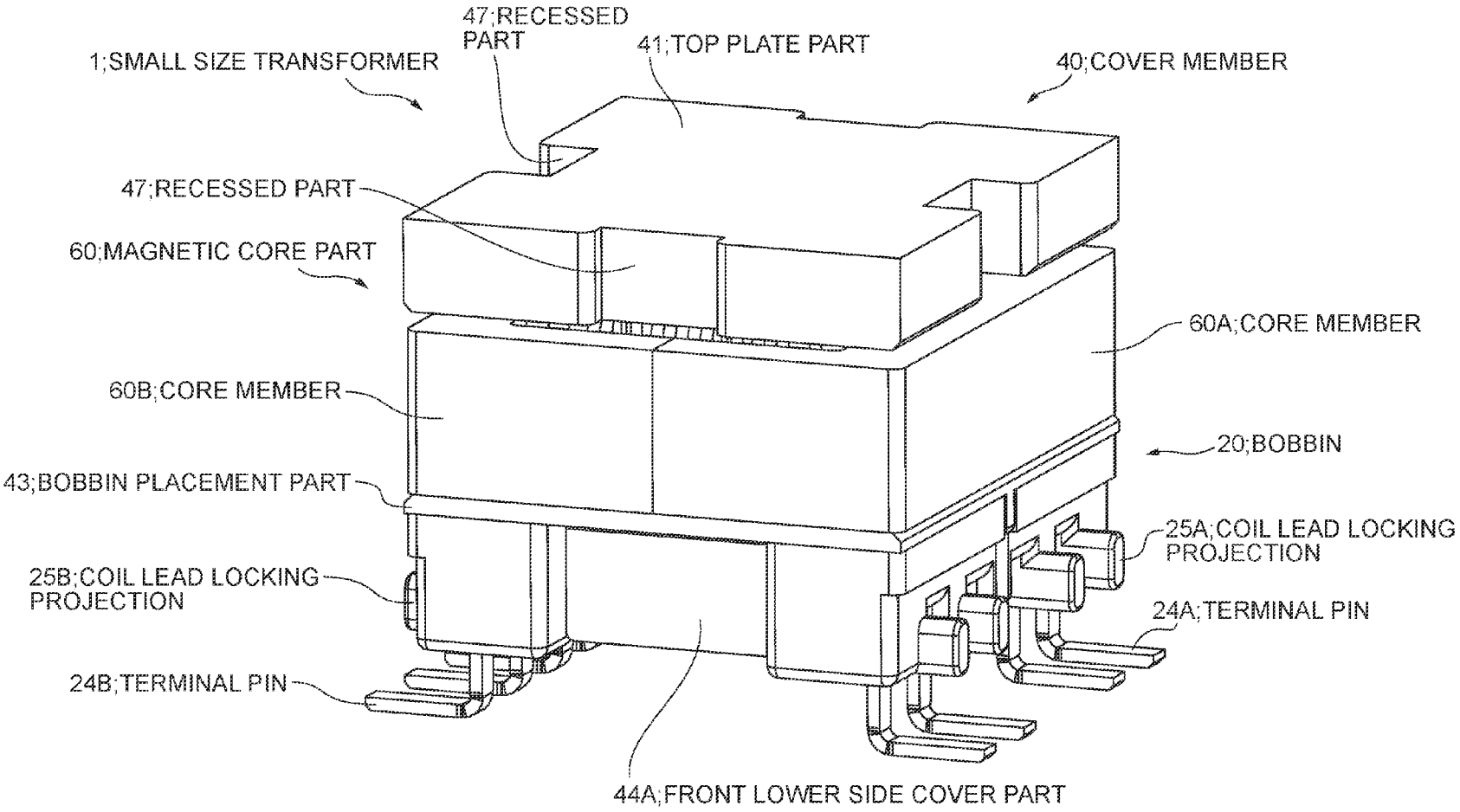
FIG. 5 shows a perspective view obtained by viewing, from an oblique front side, a state in which a magnetic core part is attached thereto in a small size transformer according to an embodiment of the present invention.

FIG. 5 is a diagram showing a state in which a magnetic core part 60 formed of core members 60A, 60B is mounted in the state of combining the members shown in FIG. 4. The core members 60A, 60B each are an E-shaped core having an identical shape, and formed of a known magnetic core such as a ferrite core and a compact core, and a bobbin 20, a cover member 40 and the magnetic core part 60 are integrally attached thereto by adhering both core members 60A, 60B to each other by abutting tips of both side leg parts and middle leg parts to each other.

In addition, outside surfaces of the bobbin 20, the cover member 40 and the magnetic core part 60 are formed into a flush state with each other in the above state.

Figure 6A:
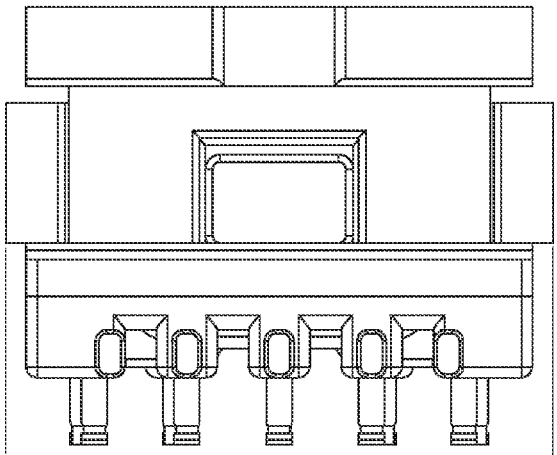
FIG. 6A CONVENTIONAL ART
FIGS. 6A and 6B are schematic views showing an external dimension difference between a small size transformer according to an embodiment of the present invention, and a small size transformer according to a conventional art.
Figure 6B:
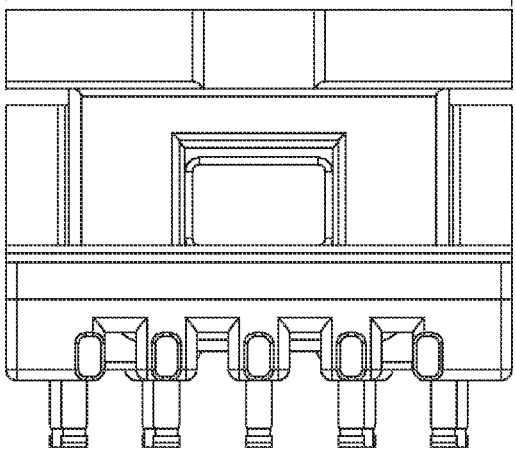

As described above, on the front side and the back side of the small size transformer 1, the inner wall surface of the core members 60A, 60B each arranged on the bobbin placement part 43 is to be abutted with a member positioned in an outermost circumference among the members each of both the end parts 21A, 21B and both the partition wall parts 22A, 22B of the bobbin 20, and the conducting wire 30 wound therearound. Therefore, as shown in FIGS. 6A and 6B, a distance in a wall thickness of the cover member 40 can be shortened in the transformer 6B according to the present embodiment in comparison with the transformer 6A according to the conventional art.

More specifically, an external dimension differenced between the transformer 6A according to the conventional art and the transformer 6B according to the present embodiment corresponds to a thickness by two walls of the cover member 40.

For example, if each of general wall thickness is taken as 0.6 mm, a thickness of two walls of front and back walls is 1.2 mm, and therefore the above-described difference d results in 1.2 mm.

If a length of a general small size transformer of such a type in the cross direction should be taken as about 10 mm, a proportion of shortening the length in the cross direction according to the present embodiment results in more than 10%, and therefore size reduction can be promoted.

Figure 7:
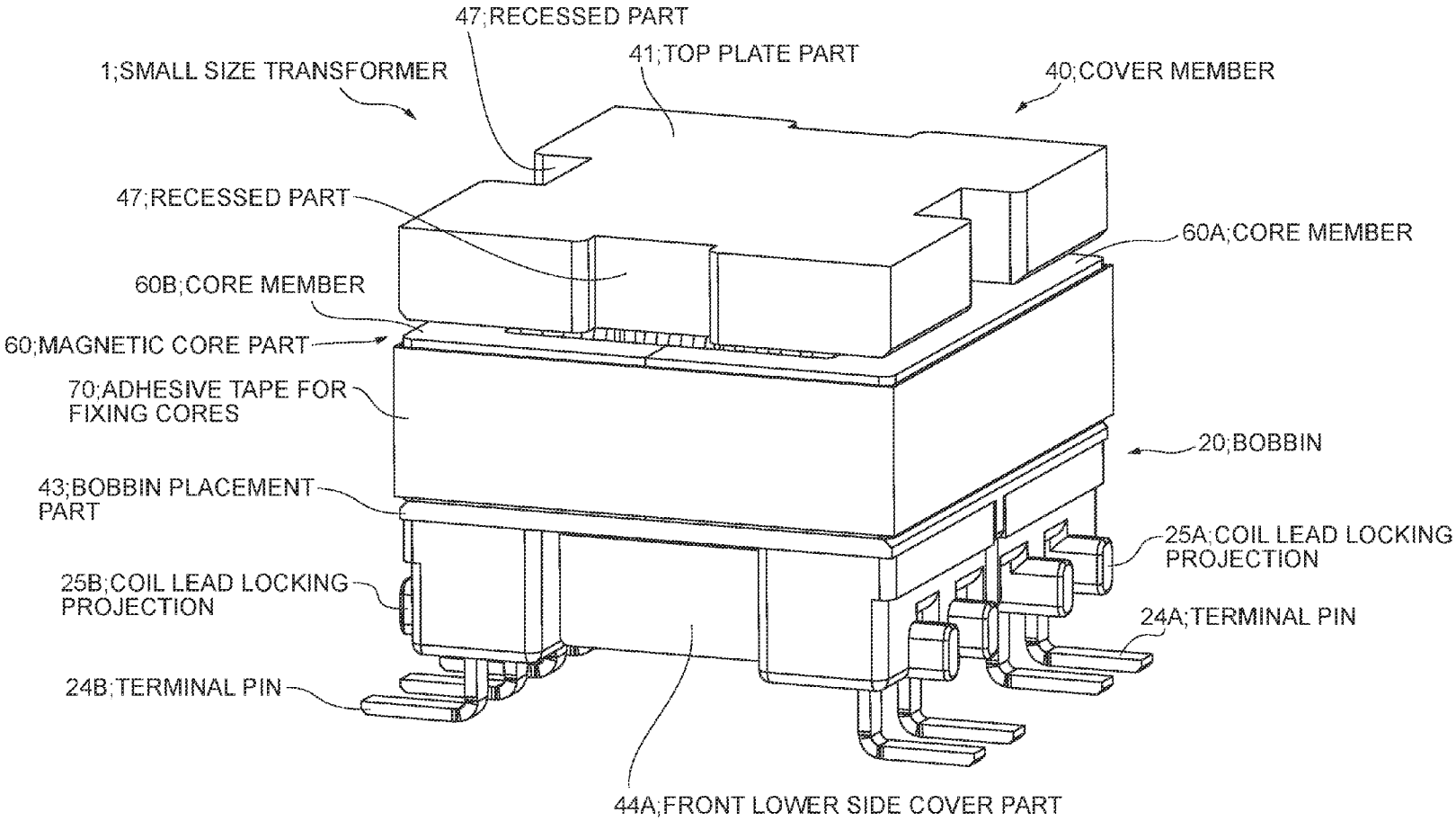
FIG. 7 shows a perspective view obtained by viewing, from an oblique front side, a state in which two core members are fixed to each other by applying an adhesive tape onto an outer circumferential part of a magnetic core part of the small size transformer shown in FIG. 5.

Incidentally, as shown in FIG. 7, an adhesive tape 70 for fixing cores is preferably adhered on both core members 60A, 60B in a manner of allowing the adhesive tape 70 to turn around (in one turn) an outer circumferential part of two core members 60A, 60B in a combined state to securely fix the two core members 60A, 60B.

Figure 8:
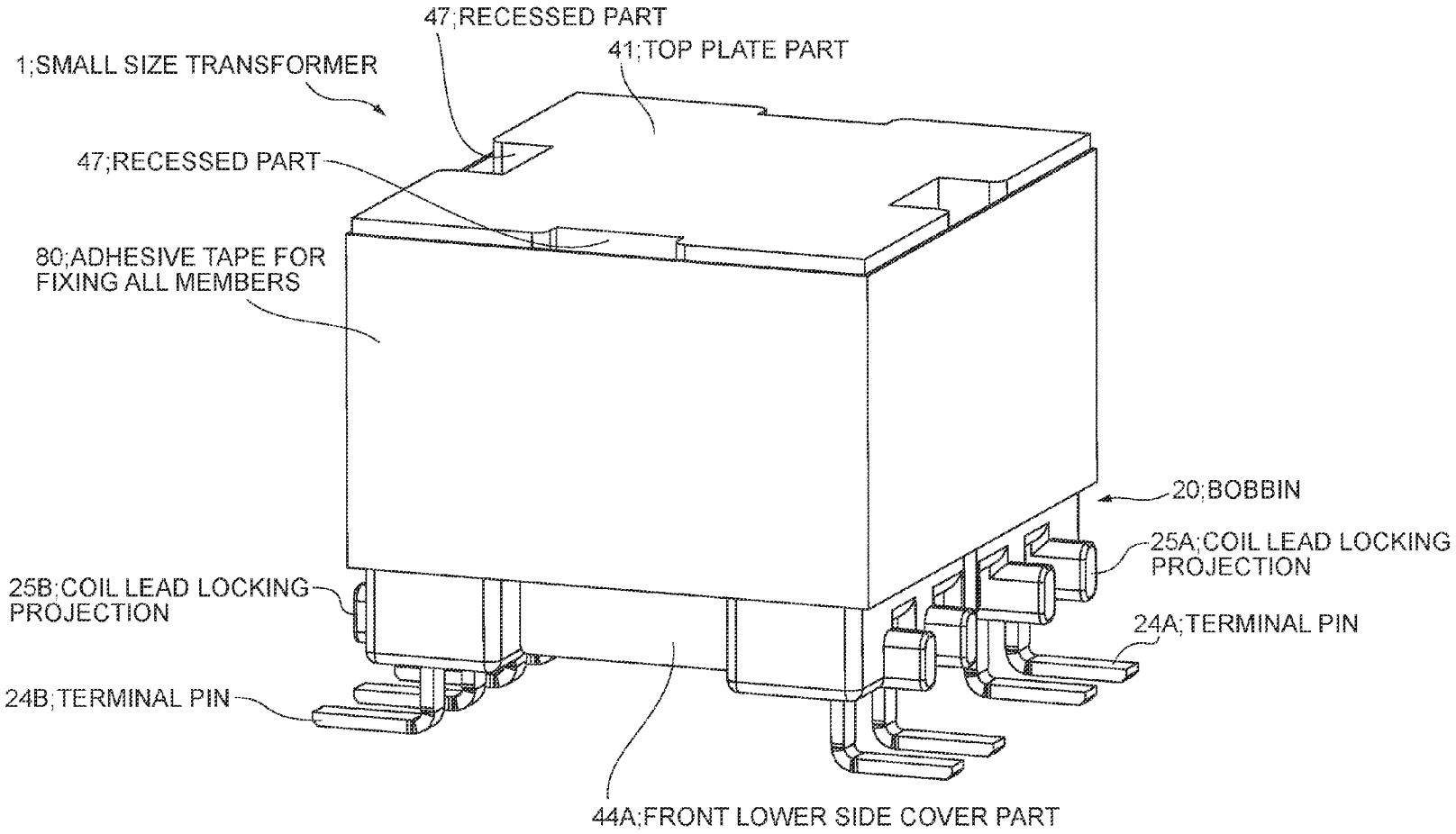
FIG. 8 shows a perspective view obtained by viewing, from an oblique front side, a state in which parts among members each are fixed with each other by applying an adhesive tape over a wide range of an outer circumferential part of the small size transformer shown in FIG. 5.
Figure 9:
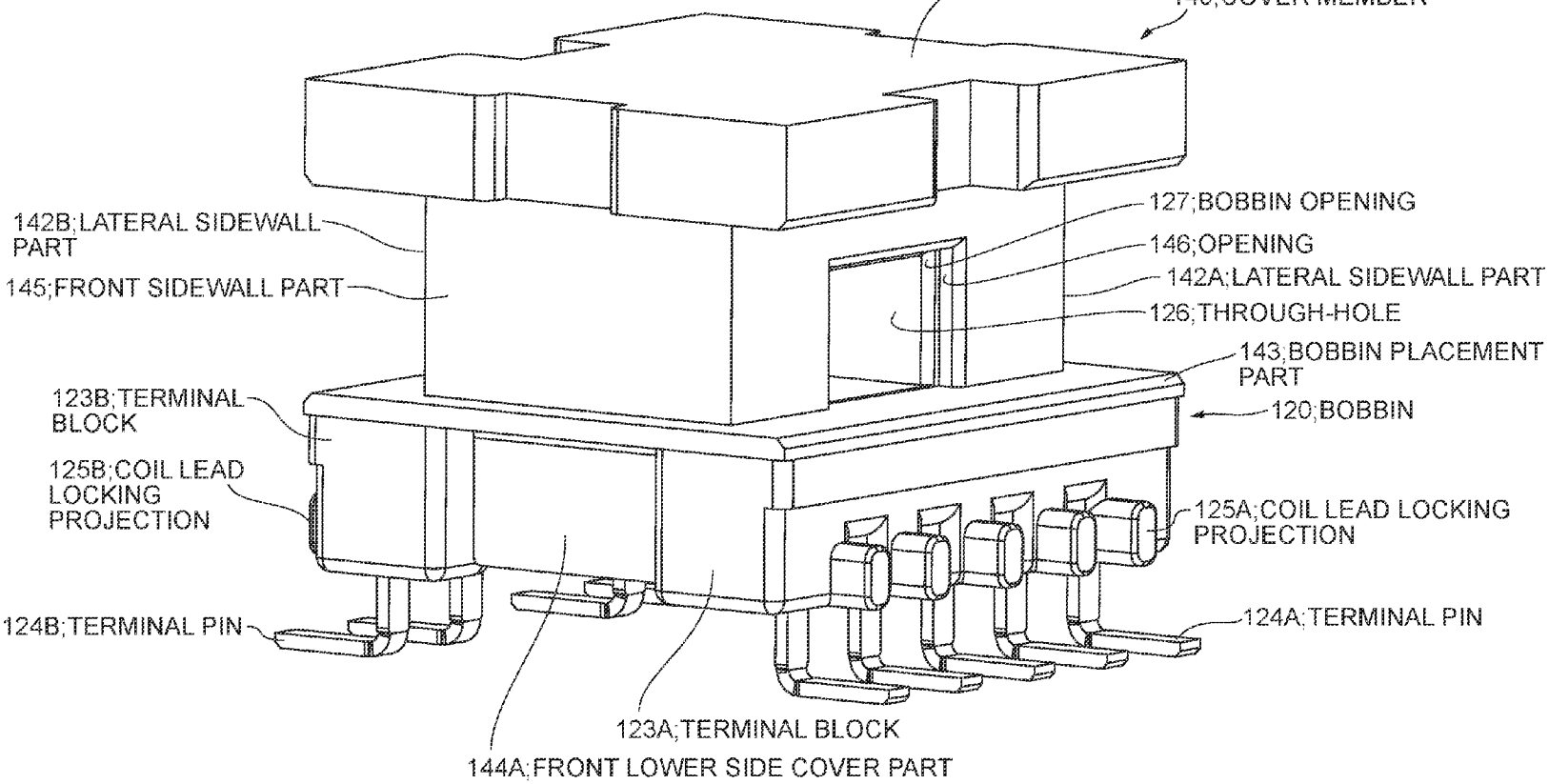
FIG. 9 CONVENTIONAL ART
FIG. 9 shows a perspective view obtained by viewing, from an oblique front side, a state in which a whole magnetic core is omitted, in a small size transformer according to the conventional art.

In the present embodiment, as described above, the outside surfaces of the bobbin 20, the cover member 40 and the magnetic core part 60 are formed into the flush state with each other. Therefore, as shown in FIG. 8, an adhesive tape 80 for fixing all members is preferably adhered thereon in a manner of allowing the adhesive tape 80 to turn therearound (in one turn) at a width at which all the members are covered over the outside surfaces each of the bobbin 20, the cover member 40 and the magnetic core part 60 to securely fix the members each of the bobbin 20, the cover member 40 and the magnetic core part 60 to each other.

The turning-around treatment using the adhesive tape 80 for fixing all the members may be applied after the above-described adhesive tape 70 for fixing the cores is turned therearound, or only the adhesive tape 80 for fixing all the members may be turned therearound without using the adhesive tape 70 for fixing the cores.

Thus, the adhesive tape 80 for fixing all the members is adhered thereon in a manner of allowing the adhesive tape 80 to turn therearound at a width at which all the members are covered over the outside surfaces each of the bobbin 20, the cover member 40 and the magnetic core part 60. Thus, the members each can be prevented from emitting a clattering sound by vibration after the small size transformer 1 has been assembled.

In particular, under an environment of high temperature and high humidity, the adhesive tape 80 also has an advantage according to which retaining performance is maintained in comparison with a bonding agent. Further, if the adhesive tape 80 is applied thereto, the adhesive tape 80 has elasticity, and therefore is also advantageous in reliability as a retaining material.

Meanwhile, as shown in FIG. 8, when the adhesive tape 80 for fixing all the members is configured to be turned around the outside surfaces of the members each, it becomes difficult to permit entry of a member from sides of the outside surfaces each into the cover member 40. For example, upon measuring insulation of the conducting wire 130, operation is required in several cases for bringing one measuring terminal into contact with the terminal pins 24A, 24B serving an extension of a conducting wire 130 and the other measuring terminal into contact with core members 60A, 60B.

However, in a state as shown in FIG. 8, in which the sidewall parts each are turned therearound and fixed by the adhesive tape 80 for fixing all the members, the above-described measuring terminal is unable to enter from the side part thereinto and abut with the core members 60A, 60B. Therefore, the above-described measuring terminal is configured to enter through a gap between the recessed part 47 provided in each side surface of the top plate part 41 of the cover member, and the adhesive tape 80 for fixing all the members to be brought into contact with the core members 60A, 60B.

The above-described adhesive tape 80 for fixing all the members is described to be able to be applied to a material according to the above-described embodiment. However, also in a general small size transformer other than the transformer according to the present invention, when the adhesive tape 80 for fixing all the members can be adhered thereon in a manner of allowing the adhesive tape 80 to turn therearound at a width at which all the members are covered over the side surfaces each of the bobbin, the cover member and the magnetic core part (the side surfaces each of the bobbin, the cover member and the magnetic core part are flush with each other), the members each can be prevented from emitting the clattering sound by vibration after the small size transformer has been assembled.

Also in the above case, the art can be described by using FIG. 8.

In addition, the small size transformer according to the present invention is not limited to the transformer according to the above-described embodiment, and transformers having other various aspects can be applied thereto.

For example, the small size transformer according to the above-described embodiment is specified to be used for various on-vehicle electronic devices. However, the small size transformer according to the present invention can be adopted as a small size transformer used for other various apparatuses.

The shapes of the bobbin and the cover member are not limited to the shapes according to the above-described embodiment, and the bobbin and the cover member can be changed to materials having various shapes and types.

For example, the number of the partition wall parts, kinds of wiring regions each (for primary wiring, for secondary wiring or the like) and a width of the bobbin can also be appropriately changed.

As described above, the core member is not limited to the two E-shaped core members, and if any core member can configure the dual-compartment shape in cross section, any core member formed by combining other shapes may be applied. Moreover, the number of the core members is not limited to two, and may be three or more.

In the above-described embodiment, the front and back sidewall portions of the cover member 40 are configured to be eliminated. However, in the small size transformer according to the present invention, if the outermost circumferential portion of the bobbin and the inner wall portion of the core member can be arranged in the close-contact state, the front and back sidewall portions need not be eliminated. For example, an opening may be provided in the front and back sidewall portions in a portion in which the outermost circumferential portion of the bobbin and the inner wall portion of the core member are arranged in the close-contact state.

In the above-described embodiment, the adhesive tape for fixing all the members is used as the adhesive belt-shaped part. However, in the small size transformer according to the present invention, the adhesive belt-shaped part is not limited thereto, and an adhesive belt-shaped part formed by applying a bonding agent onto a surface on one side of a belt-shaped base member having a predetermined width may be used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A small size transformer, comprising:

a hollow bobbin which has flange parts at least on both ends of a winding shaft part around which a conducting wire is wound, and is formed by a through-hole being pierced between the flange parts;

a box-shaped cover member to be covered on an outside of the bobbin; and a magnetic core part having a substantial dual-compartment shape in cross section to be arranged by combining a plurality of core members with each other in a manner of surrounding a side surface outer circumferential part of the cover member, wherein a rod-shaped core member portion corresponding to a midline shape in a middle step of the dual-compartment shape in the core member is configured in a manner of being inserted into the through-hole of the bobbin, the conducting wire is formed of a reinforced insulation wire, lateral sidewall portions of the cover member, facing the conducting wire wound around the bobbin, are arranged to define openings that are between the lateral sidewall portions but outside of an outermost circumferential portion of the bobbin, and the outermost circumferential portion of the bobbin and an inner wall portion of the core member are arranged facing each other in a close-contact state through the openings.

2. The small size transformer according to claim 1, wherein at least one of the openings extends completely between the lateral sidewall portions of the cover member so that there is no sidewall between the lateral sidewall portions that faces the conducting wire wound around the bobbin.

3. The small size transformer according to claim 1, wherein the plurality of core members are a pair of E-shaped core members.

4. The small size transformer according to claim 1, wherein a first engagement part is provided on one side of a top surface of a terminal block formed integrally with the bobbin, and a terminal block placement plate to be placed on the top surface of the terminal block for the cover member is provided with a second engagement part to be engaged with the first engagement part to position the cover member relative to the bobbin.

5. The small size transformer according to claim 1, wherein side surface parts each of the core member, the cover member and the bobbin are formed to be flush with each other, and the side surface parts each are formed so as to be integrally turned therearound by an adhesive belt-shaped part having a width over the side surface parts each.

6. The small size transformer according to claim 5, wherein an outer circumferential part of the plurality of core members which constitute the magnetic core member having the substantial dual-compartment shape in cross section is formed so as to be turned therearound by a core member fixing use adhesive belt-shaped part having a predetermined width.

7. The small size transformer according to claim 5, wherein a recessed part is provided in at least one sidewall portion of a top plate part of the cover member, and a gap is formed between the adhesive belt-shaped part turned around the cover member and the recessed part to permit entry into the core member through the gap.

8. The small size transformer according to claim 1, wherein the reinforced insulation wire is formed by coating and laminating a conducting wire material with two or more layers of insulation coatings.

9. The small size transformer according to claim 8, wherein the insulation coating of the reinforced insulation wire has a withstand voltage of 1,000 V or more.

* * * * *